US009859665B2

(12) United States Patent
Rohr et al.

(10) Patent No.: US 9,859,665 B2
(45) Date of Patent: Jan. 2, 2018

(54) HIGH VOLTAGE AND HIGH CURRENT POWER OUTLET

(71) Applicant: SCHNEIDER ELECTRIC IT CORPORATION, West Kingston, RI (US)

(72) Inventors: Daniel J. Rohr, Wildwood, MO (US); Weicheng Cheng, Shanghai (CN)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 237 days.

(21) Appl. No.: 14/780,839

(22) PCT Filed: Mar. 29, 2013

(86) PCT No.: PCT/CN2013/073475
§ 371 (c)(1),
(2) Date: Sep. 28, 2015

(87) PCT Pub. No.: WO2014/153779
PCT Pub. Date: Oct. 2, 2014

(65) Prior Publication Data
US 2016/0079718 A1 Mar. 17, 2016

(51) Int. Cl.
*H01R 13/703* (2006.01)
*H01R 31/06* (2006.01)
(Continued)

(52) U.S. Cl.
CPC ..... *H01R 13/703* (2013.01); *H01H 50/541* (2013.01); *H01R 13/7038* (2013.01); *H01R 31/065* (2013.01); *H01R 2103/00* (2013.01)

(58) Field of Classification Search
CPC ..... H01R 2103/00; H01R 13/7038; H01R 31/065; H01H 50/541
(Continued)

(56) References Cited

U.S. PATENT DOCUMENTS 5,418,679 A 5/1995 Crane et al.
6,495,775 B2 12/2002 Lawson et al.
(Continued)

FOREIGN PATENT DOCUMENTS

CN 102110939 A 6/2011
CN 202019113 U 10/2011
(Continued)

OTHER PUBLICATIONS

Extended European Search Report from corresponding European Application No. 13880439.8 dated Sep. 23, 2016.
(Continued)

*Primary Examiner* — Jared Fureman
*Assistant Examiner* — Duc M Pham
(74) *Attorney, Agent, or Firm* — Lando & Anastasi, LLP

(57) ABSTRACT

According to one aspect, embodiments herein provide a power distribution device including a power outlet comprising a receptacle including an internal conductor configured to be coupled to a power source and to an external conductor inserted into the receptacle, a switch configured to provide an indication of whether the external conductor has been sufficiently inserted within the receptacle, a relay configured to form a first connection between the external conductor and the power source, a transistor configured to be coupled in parallel with the relay, to form a second connection between the external conductor and the power source, and a controller configured to determine, based on the switch, that the external conductor is being removed, in response to the external conductor being removed, control the relay to sever the first connection, and in response to opening the relay, control the transistor to sever the second connection after a predetermined delay.

18 Claims, 7 Drawing Sheets

(51) Int. Cl.
*H01H 50/54* (2006.01)
*H01R 103/00* (2006.01)

(58) Field of Classification Search
USPC ..... 307/116
See application file for complete search history.

(56) References Cited

U.S. PATENT DOCUMENTS

2002/0109949 A1* 8/2002 Ueno ..... B60R 16/03 361/2
2003/0042796 A1* 3/2003 Siu ..... G06F 1/266 307/39
2005/0157443 A1* 7/2005 Bryan ..... H01R 13/7032 361/118
2012/0293153 A1* 11/2012 Garb ..... H02J 3/00 323/311
2013/0037517 A1 2/2013 Yuba et al.
2013/0069617 A1* 3/2013 Lee ..... H01R 31/065 323/318

FOREIGN PATENT DOCUMENTS

CN 102254746 A 11/2011
CN 102956382 A 3/2013
EP 1232913 A1 8/2002
JP 2006161756 A 6/2006
JP 2012119105 A 6/2012

OTHER PUBLICATIONS

Notification of Transmittal of the International Search Report and the Written Opinion of the International Searching Authority from corresponding PCT/CN2013/073475 dated Jan. 9, 2014.

* cited by examiner

HIGH VOLTAGE AND HIGH CURRENT POWER OUTLET

CROSS-REFERENCE TO RELATED APPLICATIONS

This application is a U.S. National Stage Application under 35 U.S.C. §371 of International Application No. PCT/CN2013/073475, filed Mar. 29, 2013, titled HIGH VOLTAGE AND HIGH CURRENT POWER OUTLET, which is hereby incorporated herein by reference in its entirety.

BACKGROUND OF INVENTION

1. Field of Invention

At least some embodiments described herein relate generally to power outlets.

2. Discussion of Related Art

Electrical appliances (e.g., office or home equipment, measuring instruments, medical devices, datacenter equipment such as routers and servers, etc.) may be configured to receive and operate on AC or DC power from an AC or DC source. Such electrical appliances commonly include a power supply cord that is configured to couple the electrical appliance (e.g., directly or via another device such as an Uninterruptible Power Supply (UPS)) to an AC or DC power outlet that provides AC or DC power to the appliance from the AC or DC source.

Typical power supply cords include conductors on one end which are configured to be coupled with (i.e., form an electrical connection with) conductors of the power outlet when the power supply cord is coupled to the power outlet. Once the power supply cord and the power outlet are coupled together, AC or DC power from the power outlet is provided to the electrical appliance via the outlet and power supply cord. The AC or DC power received from the power outlet may be provided directly to the electrical appliance or may first be converted to AC power and/or conditioned via a UPS coupled between the power outlet and the appliance.

SUMMARY OF INVENTION

At least one aspect of the invention is directed to a power distribution device including at least one power outlet, the at least one power outlet comprising a housing, at least one receptacle within the housing, the at least one receptacle including an internal conductor configured to be coupled to a power source and to an external conductor inserted into the at least one receptacle, a switch within the housing, the switch configured to provide an indication of whether the external conductor has been inserted at least to a predetermined point within the at least one receptacle, a relay configured to be selectively coupled between the external conductor and the power source to form a first connection between the external conductor and the power source, a transistor configured to be coupled between the external conductor and the power source, in parallel with the relay, to form a second connection between the external conductor and the power source, and a controller coupled to the relay, the transistor, and the switch, wherein the controller is configured to determine, based on the indication from the switch, that the external conductor is being removed from the at least one receptacle, in response to the determination that the external conductor is being removed from the at least one receptacle, control the relay to open and sever the first connection, and in response to opening the relay, control the transistor to turn off after a predetermined transistor delay and sever the second connection.

According to one embodiment, the controller is further configured to determine, based on the indication from the switch, that the external conductor is being inserted into the at least one receptacle, in response to the determination that the external conductor is being inserted into the at least one receptacle, control the transistor to turn on and provide power from the power source to the external conductor via the second connection, and in response to turning on the transistor, control the relay to close after a predetermined relay delay and provide power from the power source to the external conductor via the first connection.

According to one embodiment, the switch includes a mechanical switch having a first position that indicates to the controller that the external conductor has been inserted at least to the predetermined point within the at least one receptacle and a second position that indicates to the controller that the external conductor has not been inserted at least to the predetermined point within the at least one receptacle. In one embodiment, the mechanical switch is one of a ball switch and a plunger switch. In another embodiment, the switch includes an optocoupler pair including an optocoupler transmitter coupled to the housing and an optocoupler receiver located external the housing According to another embodiment, the relay is a mechanical relay including a coil coupled to the controller via a relay control line and a contact configured to be selectively coupled between the external conductor and the power source in the second connection, and in response to turning on the transistor, the controller is configured to transmit, after the predetermined relay delay, a relay control signal to the coil via the relay control line that results in the contact being coupled between the external conductor and the power source in the first connection. In one embodiment, in response to the determination that the external conductor is being removed from the at least one receptacle the controller is further configured to end transmission of the relay control signal to the coil, resulting in the opening of the relay contact and the severing of the first connection.

According to one embodiment, the at least one power outlet further comprises a transistor control line coupled between the controller and a gate of the transistor, and in response to opening the relay, the controller is configured to transmit, after the predetermined transistor delay, a first transistor control signal via the transistor control line to the gate of the transistor, the first transistor control signal operating the transistor to turn off and sever the second connection. In one embodiment, in response to the determination that the external conductor is being inserted into the at least one receptacle, the controller is further configured to transmit a second transistor control signal via the transistor control line to the gate of the transistor to turn on the transistor and provide power from the power source to the external conductor via the second connection.

According to another embodiment, the power distribution device is a power strip including a plurality of the at least one power outlets. In one embodiment, the power source is a DC power source.

Another aspect of the invention is directed to a method for controlling a power outlet, the power outlet including a housing, at least one receptacle within the housing having an internal conductor configured to be coupled to a power source and to an external conductor inserted into the at least one receptacle, a switch within the housing, a relay configured to be selectively coupled between the external conductor and the power source, and a transistor configured to be coupled between the external conductor and the power source, in parallel with the relay, the method comprising inserting the external conductor into the at least one receptacle to couple the external conductor to the internal conductor, providing, with the switch, an indication that the external conductor is being inserted into the at least one receptacle, in response to the indication by the switch that the external conductor is being inserted into the at least one receptacle, controlling the transistor to turn on and provide power from the power source to the external conductor via the transistor, and in response to turning on the transistor, controlling, after a predetermined relay delay, the relay to close and provide power from the power source to the external conductor via the relay.

According to one embodiment, the method further comprises removing the external conductor from the at least one conductor, providing, with the switch, an indication that the external conductor is being removed from the at least one receptacle, in response to an indication by the switch that the external conductor is being removed from the at least one receptacle, controlling the relay to open and sever connection from the power source to the external conductor via the relay, and in response to opening the relay, controlling, after a predetermined transistor delay, the transistor to turn off and sever connection from the power source to the external conductor via the transistor.

According to another embodiment, the switch includes a mechanical switch having a first state indicative of the external conductor being inserted into the at least one receptacle and a second state indicative of the external conductor being removed from the at least one receptacle, wherein inserting the external conductor into the at least one receptacle includes configuring the mechanical switch into the first state, and wherein removing the external conductor from the at least one receptacle includes configuring the mechanical switch into the second state.

According to one embodiment, the relay includes a coil coupled to the controller via a relay control line and a contact configured to be selectively coupled between the power source and the external conductor, and wherein controlling the relay to close includes transmitting a signal to the relay to cause the contact to couple the power source to the external conductor. In one embodiment, controlling the relay to open includes ending the transmission of the relay control signal to the relay to sever the connection between the power source and the external conductor via the relay.

According to another embodiment, the power outlet further comprises a transistor control line coupled between the controller and a gate of the transistor, and wherein controlling the transistor to turn on includes transmitting a first signal to the gate of the transistor, the first signal operating to turn on the transistor and couple the power source to the external conductor via the transistor. In one embodiment, controlling the transistor to turn off includes transmitting a second signal to the gate of the transistor, the second signal operating to turn off the transistor and sever the connection between the power source and the external conductor via the transistor.

One aspect of the invention is directed to a power distribution device including at least one power outlet, the at least one power outlet comprising a housing, at least one receptacle within the housing, the at least one receptacle including an internal conductor configured to be coupled to a power source and to an external conductor inserted into the at least one receptacle; and means for switching the at least one power outlet with a transistor and for carrying power provided from the power source to the external conductor with a relay.

According to one embodiment, the at least one power outlet further comprises means for determining whether the external conductor has been sufficiently inserted into the at least one receptacle of the at least one power outlet.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
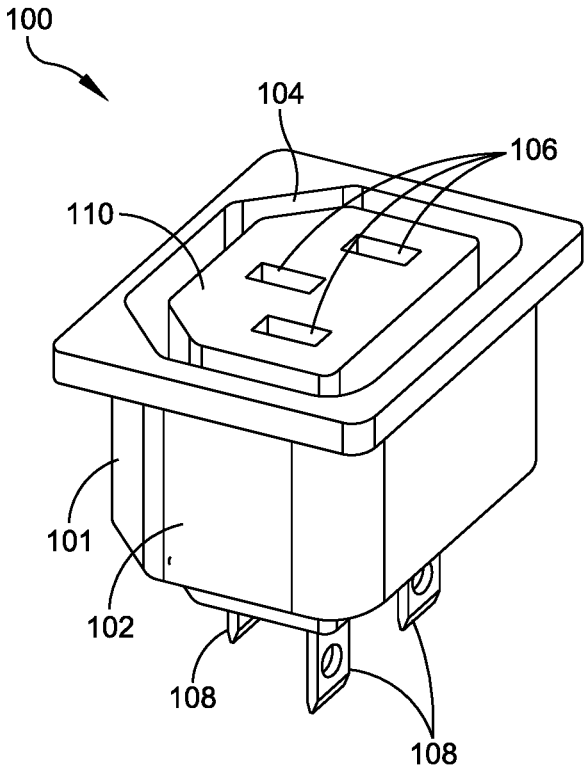
FIG. 1 illustrates a power outlet according to aspects of the current invention.

Various embodiments and aspects thereof will now be discussed in detail with reference to the accompanying drawings. It is to be appreciated that this invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

As discussed above, electronic appliances may be configured to receive power from an AC or DC source via a power supply cord coupled to a power outlet. Such common power supply cords may also be configured to be easily coupled to the power outlet and decoupled from the power outlet (i.e. plugged and unplugged to/from the power outlet).

In AC systems, and more particularly in DC systems, both sudden coupling of the conductors of a power supply cord to the conductors of an active power outlet and sudden decoupling of the conductors of the power supply cord from the conductors of an active power outlet (sudden coupling or decoupling of the power supply cord to/from the power outlet) may cause arcing and/or system damage, especially at high voltages or current. For example, a sudden decoupling of the conductors of a power supply cord from the conductors of an active power outlet (providing high voltage to the power supply cord) by a user may result in arcing between the power supply cord and the power outlet, resulting in injury to the user or damage to the system. This problem can be greater for systems using DC power.

To avoid such arcing and system damage problems, one approach is to incorporate a relay into a power outlet to control when power from the power source at the power outlet is provided to the conductors of a power cord (i.e. to the appliance or load) being coupled to or decoupled from the power outlet. In such a system, the relay is configured to both switch the power outlet (i.e., determine when power is provided to a load) and carry power provided to the load (via the power cord). This approach may be unworkable in some high voltage AC systems and more particularly in high DC voltage and/or high current systems as the switching on or off of the relay may still result in arcing between the conductors of the outlet and the conductors of the power cord. Such arcing may cause the relay to get hot or the contacts of the relay to degrade.

Another approach is to include a transistor within the power outlet, the transistor acting as a switch to control when power from the power source at the power outlet is provided to the conductors of the power cord (i.e. to the appliance or load) being coupled to or decoupled from the power outlet. In such an embodiment, the transistor is configured to both switch the power outlet (i.e. control when power is provided to a load) and carry power provided to the load (via the power cord). This approach may be undesirable in a high DC or AC voltage and/or high current environment as the transistor has an inherent insertion loss (i.e. voltage drop) which may result in the transistor overheating over time.

At least some embodiments described herein provide a power outlet including a relay and a transistor coupled in parallel such that the transistor controls switching of the power outlet and the relay carries the power provided to a load coupled to the power outlet. By switching the power outlet with the transistor and carrying the load with the relay, the arcing and damage issues identified above may be reduced.

FIG. 1 illustrates a DC power outlet 100 according to one aspect of the present invention. According to one embodiment, the DC power outlet 100 is an AC type power outlet configured for use with DC power; however, in other embodiments, another type of DC or AC power outlet may be utilized. Also, while a DC power outlet is shown, other embodiments may use AC power outlets. The DC power outlet 100 includes a housing 101. The housing 101 includes an external area 102, a center post 110, a plurality of receptacles 106, an opening 104, and a plurality of external conductors 108. The external area 102 encompasses the opening 104 and the center post 110. The opening 104 is located between the external area 102 and the center post 110. The center post 110 includes the plurality of receptacles 106. Each one of the plurality of receptacles 106 includes an internal conductor within. The plurality of external conductors 108 extend outwardly from the external area 102. Each one of the plurality of external conductors 108 also extends into the housing 101 and is coupled to the internal conductor of a receptacle 106.

The DC power outlet 100 is configured to be coupled to a power supply cord of an electrical appliance. According to one embodiment, the power supply cord includes a connector at one end that is configured to be coupled with the DC power outlet 100. For example, in one embodiment, a connector of a power supply cord (e.g., a plug) is configured to be inserted into the opening 104 and to encompass the center post 110. Upon being inserted into the opening 104 and encompassing the center post 110, an external conductor of the power cord connector is inserted into each one of the plurality of receptacles 106. Each external conductor of the power cord connector extends into its corresponding receptacle 106 and makes contact with the internal conductor within the receptacle 106. Upon being connected to the internal conductor within a receptacle 106, a conductor of the power cord connector is also electrically coupled to one of the plurality of external conductors 108.

The plurality of external conductors 108 are configured to be coupled to an external DC power source. In one embodiment, a plurality of the outlets 100 may be contained within a power distribution unit (e.g., a power strip) with each of the external conductors 108 coupled to internal conductors in the power distribution unit. In another embodiment, rather than extending from the external area 102, the plurality of external conductors 108 may instead be located at the end of a cord coupled to the external area 102. In such an embodiment, the plurality of external conductors 108 located at the end of the cord may be inserted into another outlet (e.g., a wall outlet or DC power distribution unit) which is coupled to the DC power source. In another embodiment, the plurality of external conductors 108 are removed and the internal conductors within each one of the receptacles 106 are coupled directly to the DC power source (e.g., via a cord or wire).

According to one embodiment, the DC power outlet 100 is an International Electrotechnical Commission (IEC) 320 C13 female type coupler configured to be connected to an IEC 320 C14 male type inlet (e.g., at the end of a power cord coupled to an electrical appliance). However, in other embodiments, the DC power outlet 100 may be any type of IEC 320 or 60320 standard coupler that is configured to be connected to its corresponding IEC 320 or 60320 standard inlet.

Once the DC power source is coupled to a load (e.g., via the external conductors 108, the internal conductors within the receptacles 106, and the conductors of a power cord), the DC power source is able to provide DC power to the load. However, as described above, the insertion and removal of the conductors of the power cord to/from the receptacles 106 (i.e. the coupling and decoupling of the conductors to/from the internal conductors of the DC outlet 100) may result in arcing or system damage issues. Therefore, control circuitry within, or near, the DC outlet 100 operates to control when DC power from the DC power source is provided to the load, to reduce potential arcing and damage issues.

Figure 2:
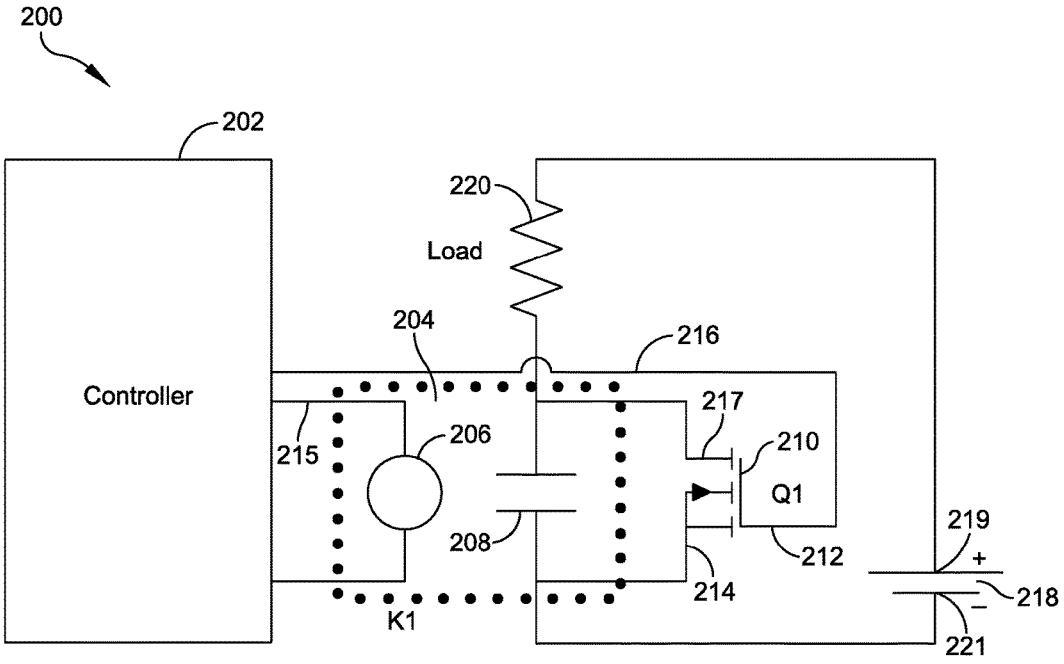
FIG. 2 is a block diagram of control circuitry of a power outlet according to aspects of the current invention.

FIG. 2 is a block diagram of control circuitry 200 within the DC power outlet 100 in accordance with one embodiment described herein. FIG. 2 illustrates the control circuitry 200 in relation to a load 220 and a DC power source 218 to which the DC power outlet 100 is coupled. For example, the load 220 may be an electrical appliance coupled to the DC power outlet 100 via a power cord as described above, and the DC source 218 may be coupled to the external conductors 108 (or directly to the DC power outlet 100) as also described above.

The control circuitry 200 includes a controller 202, a relay 204, and a transistor 210. The relay 204 includes a coil 206 and contacts 208. According to one embodiment, the transistor 210 is an Insulated-Gate Bipolar Transistor (IGBT); however, in other embodiments, any type of transistor such as a Field Effect Transistor (FET) or a Bipolar Junction Transistor (BJT) may be utilized.

The controller 202 is coupled to the coil 206 of the relay 204 via a relay control line 215 and to the gate 212 of the transistor 210 via a transistor control line 216. The contacts 208 of the relay 204 are coupled between the negative side 221 of the power source 218 and the load 220. The transistor 210 is coupled in parallel with the contacts 208 of the relay 204 such that the source 214 of the transistor 210 is coupled to the negative side 221 of the DC source 218 and the drain 217 of the transistor 210 is coupled to the load 220. The positive side 219 of the DC source 218 is also coupled to the load 220.

The controller 202 is configured to sense when a connector (e.g., a plug) of a power cord, coupled to the load 220, is coupled to the DC power outlet 100. For example, in one embodiment, the controller 202 is configured to determine when the conductors of a power cord connector are sufficiently inserted into the receptacles 106 of the DC power outlet 100 (i.e. are inserted at least to a specific point within the receptacles 106). According to one embodiment, the controller 202 monitors the status of a switch that provides an indication whether the conductors of a power cord connector are sufficiently inserted into the receptacles 106 or not. For example, in one embodiment, the switch is open when conductors of a power cord connector are not sufficiently inserted into the receptacles 106 (i.e. not inserted at least to a specific point within the receptacles 106) and closed when the conductors of a power cord connector are sufficiently inserted into the receptacles 106 (i.e. inserted at least to a specific point within the receptacles. According to one embodiment, the switch is a mechanical switch that is open if conductors of a power cord connector are partially inserted into the receptacles 106 of the DC power outlet 100 (or not inserted at all), and closed if conductors of a power cord connector are sufficiently inserted into the receptacles 106 of the DC power outlet 100.

Figure 3A:
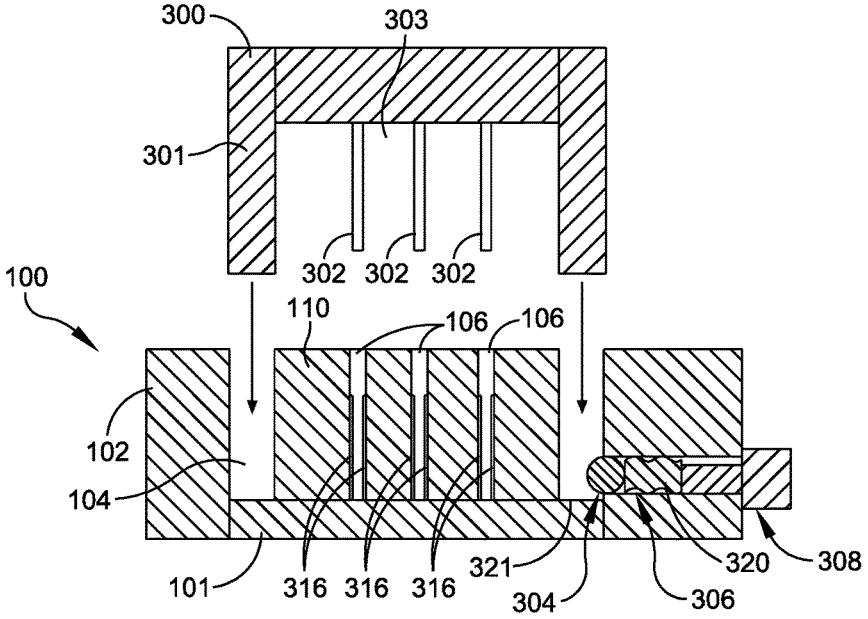
FIG. 3A illustrates a power outlet including a ball switch according to aspects of the current invention.

FIG. 3A illustrates the DC power outlet 100 including a mechanical switch 320 in accordance with one embodiment described herein. As shown in FIG. 3A, the mechanical switch 320 is a ball switch; however, in other embodiments, a different type of mechanical switch, such as a plunger switch, may be utilized. The DC power outlet 100 also includes the housing 101 which includes the external area 102, the opening 104, the center post 110, and the plurality of receptacles 106 as described above. The mechanical switch 320 is located within the external area 102 at a location near a bottom area 321 of the opening 104. According to one embodiment, the mechanical switch 320 includes a ball (or ellipsoid) 304, a spring 306, and a button 308. The mechanical switch 320 extends through the external area 102 such that a portion of the ball 304 extends into the opening 104. The spring is located between the ball 304 and the button 308. The button 308 may be coupled to the controller 202 (as seen in FIG. 2).

As described above, the DC power outlet 100 is configured to be coupled to a power supply cord connector 300 (e.g., a plug) of a load (e.g., an electrical appliance). The connector 300 includes a housing 301, an opening 303, and a plurality of external conductors 302. The housing 301 encompasses the opening 303 which includes the plurality of conductors 302. The plurality of conductors 302 are coupled to the load via the power cord (or directly) and are configured to provide power from the power outlet 100 to the load.

When the plug 300 and the DC power outlet 100 are decoupled, the button 308 of the mechanical switch 320 is extended (i.e. the mechanical switch 320 is open) and the controller 202 senses that the plug 300 has not been sufficiently inserted into the DC power outlet 100 (i.e. because the plug 300 has not been inserted far enough into the outlet 100 to alter the configuration of the switch 320). When a user wishes to couple the plug 300 to the DC power outlet 100, the user inserts the housing 301 of the plug 300 into the opening 104. When the housing 301 of the plug 300 is being inserted into the opening 104, each one of the plurality of conductors is also being inserted into a receptacle 106.

Once an external conductor 302 is inserted within a receptacle 106 (even if the plug 300 is not sufficiently inserted into the opening 104 of the outlet 100) it may be coupled to an internal conductor 316 within the receptacle 106 that is also coupled to the DC power source (e.g., via external conductors, directly, or via a power cord) as discussed above. Therefore, once the external conductors 302 are coupled to the internal conductors 316 within the receptacles 106, the load coupled to the conductors 302 is capable of being provided DC power from the DC power source coupled to the internal conductors 316. When the conductors 302 are coupled to the internal conductors 316 within the receptacles 106 but the plug 300 is not yet sufficiently inserted into the opening 104 of the outlet 100, the button 308 of the mechanical switch 320 remains extended (i.e. the mechanical switch 320 stays open as the plug 300 has yet to reach the mechanical switch 320) and the controller 202 continues to sense that the plug 300 has not been sufficiently inserted into the DC power outlet 100.

When the housing 301 of the plug 300 is sufficiently inserted into opening 104 of the outlet 100 (i.e. the housing 301 of the plug 300 is inserted to the point of the mechanical switch 320), the housing 301 is pressed against the ball 304. The ball 304 moves within the external area 102, in a direction perpendicular to the movement of the housing 301, and is pushed against the spring 306. The spring 306 is compressed and pushed against the button 308. Pushed by the ball 304 and spring 306, the button 308 is depressed (i.e. the mechanical switch 320 is closed) and the controller 202 senses that the plug 300 has been sufficiently inserted into the DC power outlet 100.

When the user wishes to decouple the plug 300 from the outlet 100, the user pulls on the housing 301 of the plug 300 and begins to remove the housing 301 from the opening 104 of the outlet 100. As the housing 301 is removed from the opening 104, the conductors 302 are also removed from the receptacles 106. Once the housing 301 is no longer in contact with the ball 304 of the switch 320, the spring 306 decompresses, pushing the ball 304 back into the opening 104 and allowing the button 308 to extend (i.e. the mechanical switch 320 is opened). Once extended, the button 308 provides an indication to the controller 202 that the plug 300 is being removed from the DC power outlet 100 (i.e. as the plug 300 is no longer extending to the switch 320 within the outlet 100). However, even though the mechanical switch 320 is open (indicating that the plug 300 is only partially coupled to the outlet 100), the conductors may remain coupled to the internal conductors 316 of the receptacles 106. The user continues to pull on the housing 301 until the housing 301 is completely removed from the opening 104 and the conductors 302 are completely decoupled from the internal conductors of 316 the receptacles 106.

Figure 3B:
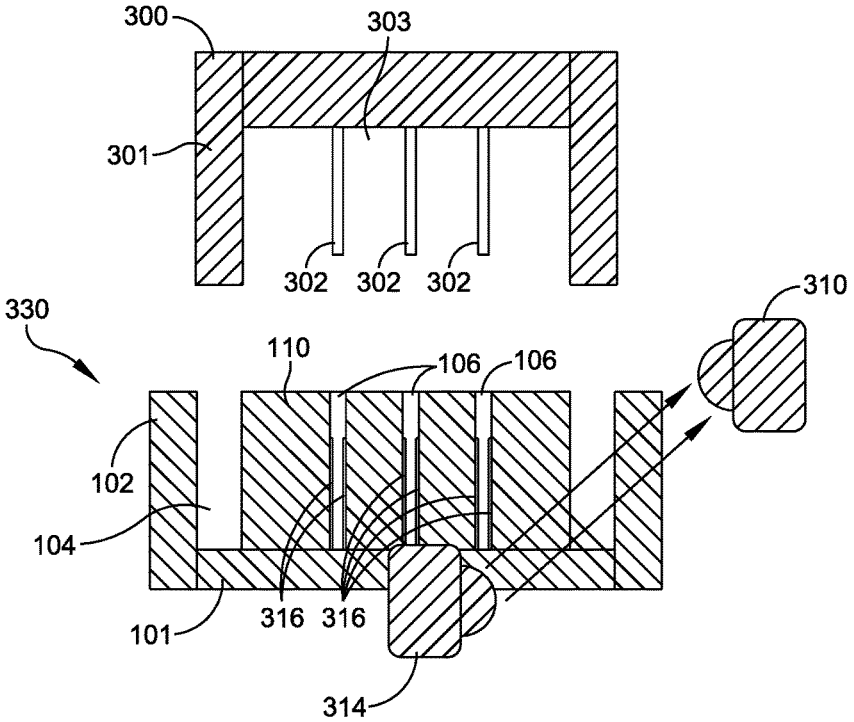
FIG. 3B illustrates a power outlet including an optocoupler according to aspects of the current invention.

According to other embodiments, a DC power outlet may include another type of switch capable of providing an indication to the controller 202 of whether the plug 300 is sufficiently coupled to the outlet 100. For example, in one embodiment, the switch is an optocoupler pair. FIG. 3B illustrates a DC power outlet 330 including an optocoupler pair 310, 314 in accordance with one embodiment described herein. The DC power outlet 330 illustrated in FIG. 3B is substantially the same as the DC Power outlet 100 illustrated in FIG. 3A except that the mechanical switch 320 of FIG. 3A is replaced by the optocoupler pair 310, 314.

As shown in FIG. 3B, an optocoupler transmitter 314 of the optocoupler pair is coupled to the center post 110 of the outlet 330 and an optocoupler receiver 310 of the optocoupler pair is located at a position external the outlet 330. The optocoupler receiver 310 is also coupled to the controller 202. While the plug 300 and the DC power outlet 330 are decoupled, signals transmitted by the transmitter 314 are received by the receiver 310, indicating to the controller 202 that the plug 300 has not been sufficiently inserted into the DC power outlet 330. When a user inserts the housing 301 of the plug 300 into the opening 104 of the outlet 330, as described above, the housing 301 blocks the signals transmitted by the transmitter 314 and the receiver 310 no longer receives the signals, indicating to the controller 202 that the plug 300 has been inserted into the outlet 330.

According to one embodiment, the optocoupler pair 310, 314 may be configured such that the transmissions between the transmitter 314 and receiver 310 are only blocked when the housing 304 of the plug 300 is sufficiently inserted into the opening 104 of the outlet 330. Therefore, in such an embodiment, as the plug 300 is inserted into the outlet 330, the conductors 302 of the plug 300 may be coupled to the internal conductors 316 of the receptacles 106 prior to the optocoupler pair 310, 314 indicating to the controller 202 that the plug 300 is sufficiently inserted into the outlet 330. Similarly, as the plug 300 is removed from the outlet 330, the conductors 302 of the plug 300 may remain coupled to the internal conductors 316 of the receptacles 106 even after the optocoupler pair 310, 314 has indicated to the controller 202 that the plug 300 is being removed from the outlet 330.

Referring back to FIG. 2, operation of the outlet 100 will now be further described. The outlet 330 operates in a similar manner using the optical switch in place of the mechanical switch of the outlet 100. The controller 202 determines when the plug 300 of a power cord (coupled to load 220) is sufficiently inserted into the DC power outlet 100 based on the state of a switch within the outlet 100 (e.g., a mechanical switch 320, optocoupler pair 310, or other type of switch) as described above. Once the controller 202 senses that the plug 300 is sufficiently inserted into the outlet 100 (e.g., because the mechanical switch 320 is closed or the optocoupler transmissions are blocked), the controller 202 operates the control circuitry 200 to provide power to the load 220.

Upon receiving an indication from the switch 320 that the plug 300 is sufficiently inserted into the outlet 100, the controller 202 sends a signal, via the transistor control line 216, to the gate 212 of the transistor 210 to turn on the transistor 210, thereby coupling the load 220 to the negative side 221 of the DC source 218. Upon being turned on, the transistor 210 carries power from the DC source 218 to the load 220.

After a predetermined relay delay (e.g., determined by circuitry within the controller 202 or programming of the controller 202), the controller 202 transmits a signal, via the relay control line 215, to the coil 206 of the relay 204. The signal through the coil 206 induces a magnetic field that forces the contacts 208 of the relay 204 to close, thereby coupling the load 220 to the negative side 221 of the DC source 218. According to one embodiment, the predetermined relay delay is in the range of 10 to 100 ms; however, in other embodiments, the relay delay may defined as any appropriate value.

As the resistance of the connection between the load 220 and the DC source 218 via the relay 204 is less than the resistance of the connection between the load 220 and the DC source 218 via the transistor 210, once the relay 204 is closed, power provided from the DC source 218 to the load 220 is carried by the relay 204. According to one embodiment, as power is being provided to the load 220 from the DC source 218 via the relay 204, the on or off state of the transistor 210 is irrelevant to the power being provided to the load 220. The controller 202 may leave the transistor 210 on or turn the transistor 210 off, through signals to the gate 212 via the transistor control line 216, and the current state of the transistor 210 will not impact the power being provided to the load 220 via the relay 204. Power provided from the DC source 218 to the load 220 may be carried by the relay 204 until a user desires to decouple the plug 300 of the power cord from the power outlet 100.

Once a user beings to remove the plug 300 from the outlet 100, the switch within the outlet 100 (e.g., the mechanical switch 320, the optocoupler pair 310, 314, or another type of switch) provides an indication to the controller 202 that the plug 300 is being removed from the outlet 100. Upon determining that the plug 300 is being removed from the outlet 100 (e.g., based on an open status of the mechanical switch 320 or the optocoupler transmissions being blocked), but prior to the electrical connection between the DC outlet 100 and the plug 300 being completely severed (as the conductors 302 of the plug 300 are still coupled to the internal conductors 316 within the receptacles 106), the controller 202 confirms that the transistor 210 is on and ends transmission of the signal through the coil 206 that previously generated the magnetic field. As a result, the contacts 208 of the relay 204 open, thereby severing the connection between the load 220 and the DC power supply 218 via the relay 204.

Once the connection between the load 220 and the DC power supply 218 via the relay 204 is severed, power is again provided to the load 220 from the DC source 218 via the transistor 210 (which, according to some embodiments, could either have been left on continuously while power was provided to the load 220 via the relay 204, or turned back on prior to the opening of the relay 204). After a predetermined transistor delay (e.g., determined by circuitry within the controller 202 or programming of the controller 202), the controller 202 transmits a signal to the gate 212 of the transistor 210, via the transistor control line 216, to turn off the transistor 210, thereby completely decoupling the load 220 from the negative side 221 of the DC source 218 and stopping power from being provided from the DC power outlet 100 to the load 220. Complete separation of the power cord from the power outlet 100 may then be completed by the user. According to one embodiment, the predetermined transistor delay is in the range of 10 to 100 ms; however, in other embodiments, the transistor delay may defined as any appropriate value.

The transistor 210, rather than the relay 204 or the internal conductors, is configured to commutate power provided from the outlet 100 to the load 220. Accordingly, by switching the power outlet 100 (i.e. determining when power is provided to the load 220 from the outlet 100) with the transistor 210 and carrying power to the load 220 with the relay 204, the arcing and damage issues identified above may be reduced.

Figure 4:
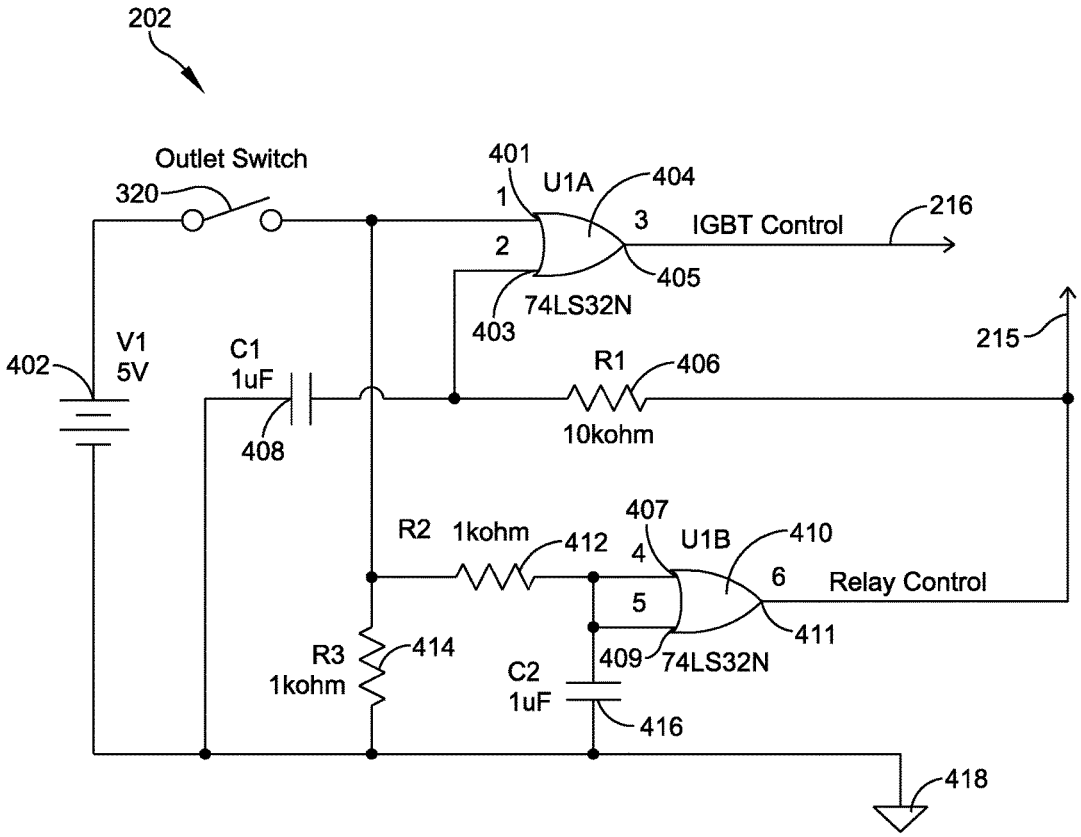
FIG. 4 is a schematic diagram of a power outlet controller according to aspects of the current invention.

FIG. 4 is a more detailed schematic diagram of the controller 202 in accordance with one embodiment described herein. The controller 202 includes a first OR gate 404, a second OR gate 410, a first capacitor (with capacitance C1) 408, a second capacitor (with capacitance C2) 416, a first resistor (with resistance R1) 406, a second resistor (with resistance R2) 412, a third resistor (with resistance R3) 414, ground 418, the transistor control line 216, and the relay control line 215.

According to one embodiment, the mechanical switch 320 is selectively coupled between a controller power supply 402 (e.g., a 5V supply) and a first input terminal 401 of the first OR gate 404. The first input terminal 401 of the first OR gate 404 is also coupled to a first input terminal 407 of the second OR gate 410 via the second resistor 412 and to ground 418 via the third resistor 414. The second input terminal 409 of the second OR gate 410 is coupled to the first input terminal 407 of the second OR gate 410 and to the ground 418 via the second capacitor 416. The relay control line 215 is coupled to the output 411 of the second OR gate 410. The second input terminal 403 of the first OR gate 404 is coupled to the relay control line 215 via the first resistor 406 and to ground via the first capacitor 408. The transistor control line 216 is coupled to the output 405 of the first OR gate 404.

Figure 5:
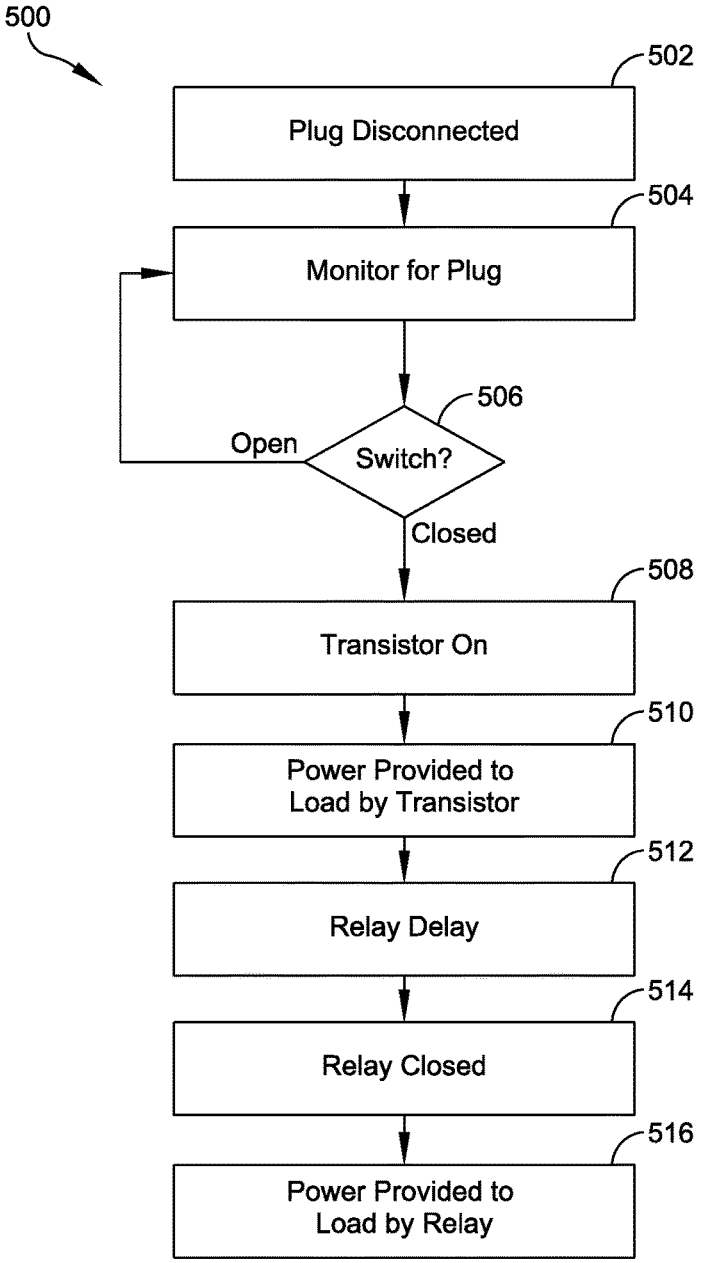
FIG. 5 is a flow chart illustrating a process for coupling a plug to a power outlet according to aspects of the current invention.
Figure 6:
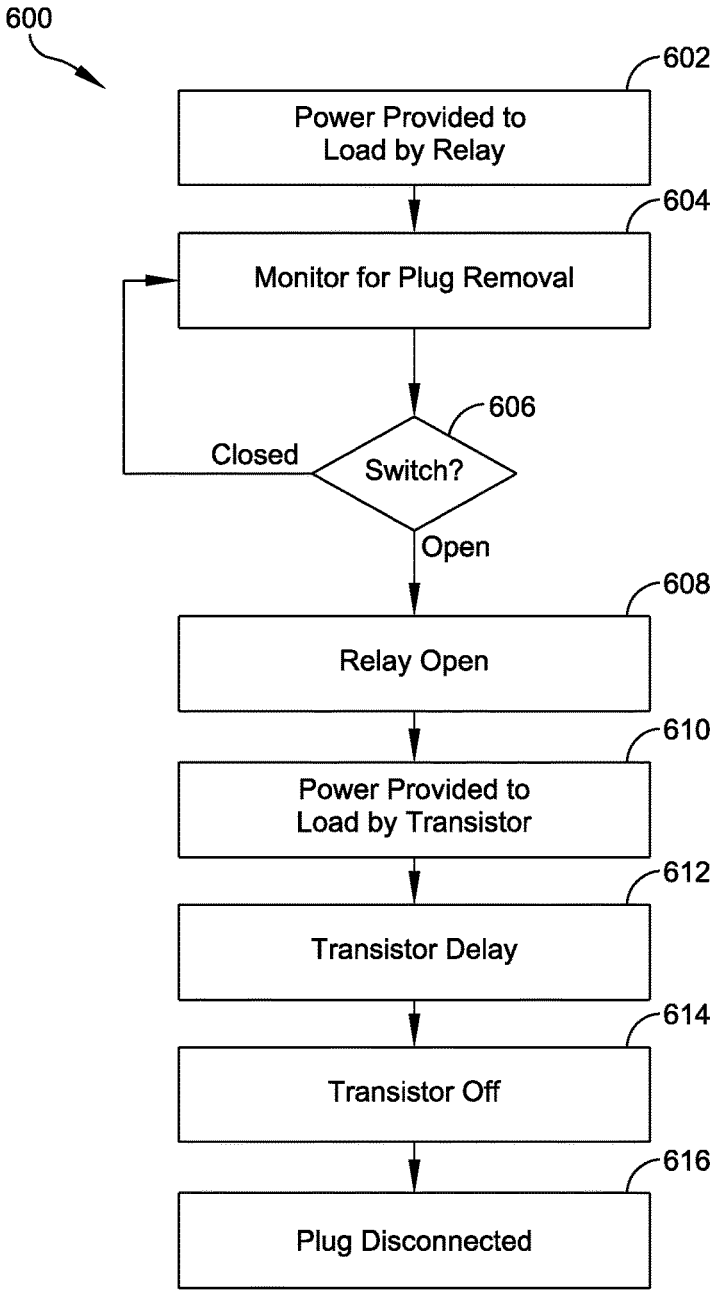
FIG. 6 is a flow chart illustrating a process for decoupling a plug from a power outlet according to aspects of the current invention.

Operation of the controller 202 is now described in relation to FIGS. 5 and 6. FIG. 5 is a flow chart illustrating a process for coupling the plug 300 to the DC power outlet 100. At block 502, the plug 300 is disconnected from the DC power outlet 100, the switch 320 is open (providing an indication to the controller 202 that the plug 300 is not sufficiently coupled to the DC power outlet 100), and the controller 202 is not providing control signals to either the transistor 210 or the relay 204.

At block 504, while the plug 300 is disconnected from the outlet 100, the controller 202 continuously monitors for an indication, provided by the switch 320, that a plug 300 has been sufficiently inserted into the outlet 100 (i.e. that a plug 320 has been inserted at least to the location of the switch 320 within the outlet 100). At block 506, a determination is made whether the switch 320 is open or closed. In response to the switch 320 being open (because a plug 300 has not been sufficiently inserted into the outlet 100), the supply voltage 402 is not provided to the control circuit 202 and the controller 202 does not provide controls signals to either the transistor 210 or relay 204.

At block 508, in response to the switch 320 being closed, the supply voltage 402 is provided to the first input terminal 403 of the OR gate 404, thereby driving the output 405 of the OR gate 404 high. The high signal at the output 405 of the first OR gate 404 is provided, as a transistor control signal, to the gate 212 of the transistor 210 via the transistor control line 216. The high transistor control signal on the transistor control line 216 turns on the transistor 210, thereby coupling the load 220 to the DC source 218. At block 510, power from the DC source 218 is provided to the load 220 via the transistor 210.

Once the switch 320 is closed in response to a plug 300 being sufficiently inserted into the outlet 100, the supply voltage 402 is also provided to the first input terminal 407 and the second input terminal 409 of the second OR gate 410 via the second resistor 412. At block 514, after a predetermined relay delay 512 defined by the time constant R2/C2, the voltage provided to the second OR gate 410 drives the output 411 of the second OR gate 410 high. The high signal at the output 411 of the second OR gate 410 is provided, as a relay control signal, to the coil 206 of the relay 204 via the relay control line 215. The high relay control signal through the coil 206 induces a magnetic field which forces the contacts 208 of the relay 204 closed, thereby coupling the load 220 to the DC source 218. According to one embodiment, once the relay is closed, the transistor 210 may remain on or may be turned off At block 516, due to the relatively low resistance of the relay contacts 208 as compared to the transistor 210, power from the DC source 218 is provided to the load 220 via the relay 204. According to one embodiment R2 has a value of 1 kohm and C2 has a value of 1 μF; however, in other embodiments, the values of R2 and C2 may be defined as any appropriate values.

By first switching on the outlet 100 with the transistor 210 and then subsequently carrying power to the load 220 with the relay 204, the insertion loss problem related to carrying power with the transistor 210 and the contact degradation problem related to switching on the outlet 100 with the relay 204 may be avoided.

FIG. 6 is a flow chart illustrating a process for decoupling the plug 300 from the DC power outlet 100. At block 602, the plug 300 is sufficiently coupled to the DC power outlet 100, the switch 320 is closed, and the controller 202 is providing control signals to the relay 204 to close the contacts 208 of the relay 204, thereby coupling the load 220 to the DC power source 218 via the relay 204.

At block 604, while the plug 300 is sufficiently connected to the outlet 100, the controller 202 continuously monitors for an indication, provided by the switch 320, that the plug 300 is being removed from the outlet 100 (i.e. that the plug 300 is no longer inserted into the outlet 100 at least at the location of the switch 320). At block 606, a determination is made whether the switch 320 is open or closed. In response to the switch 320 remaining closed (because a plug 300 is sufficiently inserted into the outlet 100), the supply voltage 402 continues to be provided to the second OR gate 410 of the controller 202, thereby driving the relay control signal high. As can be seen in FIG. 4, a high relay control signal on the relay control line 215 is also provided to the second terminal 403 of the first OR gate 404, thereby driving the transistor control signal on the transistor control line 216 high.

At block 608, in response to the switch 320 opening (e.g., in response to a plug 300 beginning to be removed from the outlet 100), the supply voltage 402 is disconnected from the first terminal 401 of the first OR gate 404 and the first and second terminals 407, 409 of the second OR gate 410. As a result, the relay control signal at the output 411 of the second OR gate 410 goes low. The low relay control signal on the relay control line 215 (provided to the coil 206) results in the contacts 208 of the relay 204 opening, thereby severing the connection between the load 220 and the DC source 218 via the relay 204. Subsequently, at block 610, power is again provided from the DC source 218 to the load 220 via the transistor 210 as the transistor remains turned on by the high transistor control signal on the transistor control line 216 (driven by the high signal at the second terminal 403).

Once the relay 204 is opened and after a predetermined transistor delay 612 defined by the time constant (R1/C1)/(R2/C2), at block 614 the low relay control signal on the relay control line 215 is provided to the second terminal 403, resulting in the transistor control signal at the output 405 going low. The low transistor control signal on the transistor control line 216 is provided to the transistor 210, turning the transistor off and thereby decoupling the load 220 from the DC power source 218. At block 616, as the load 220 is no longer coupled to the DC source 218, the plug 300 may be completely removed from the outlet 100 (i.e. the conductors 302 of the plug 300 may be decoupled from the internal conductors 316 within the receptacles 106). According to one embodiment, R1 has a value of 10 kohm and C1 has a value of 1 μF; however, in other embodiments, the values of R1 and C1 may be defined as any appropriate values.

By first ceasing to carry power with the relay 204 and then subsequently switching off the outlet 100 with the transistor, the insertion loss problem related to carrying power with the transistor 210 and the contact degradation problem related to switching off the outlet 100 with the relay 204 may be avoided.

As described herein, the relay 204 and the transistor 210 are coupled in parallel between the load 220 and the negative side 221 of the DCs source 218; however, in other embodiments, the relay 204 and transistor 210 may be coupled in parallel between the load 220 and the positive side 219 of the DC source 218.

As described herein, the DC power outlet 100 is configured to be coupled to a plug 300 having three conductors 302; however, in other embodiments, the DC power outlet 100 may be configured to be coupled to any type of plug having any number of conductors.

Figure 7:
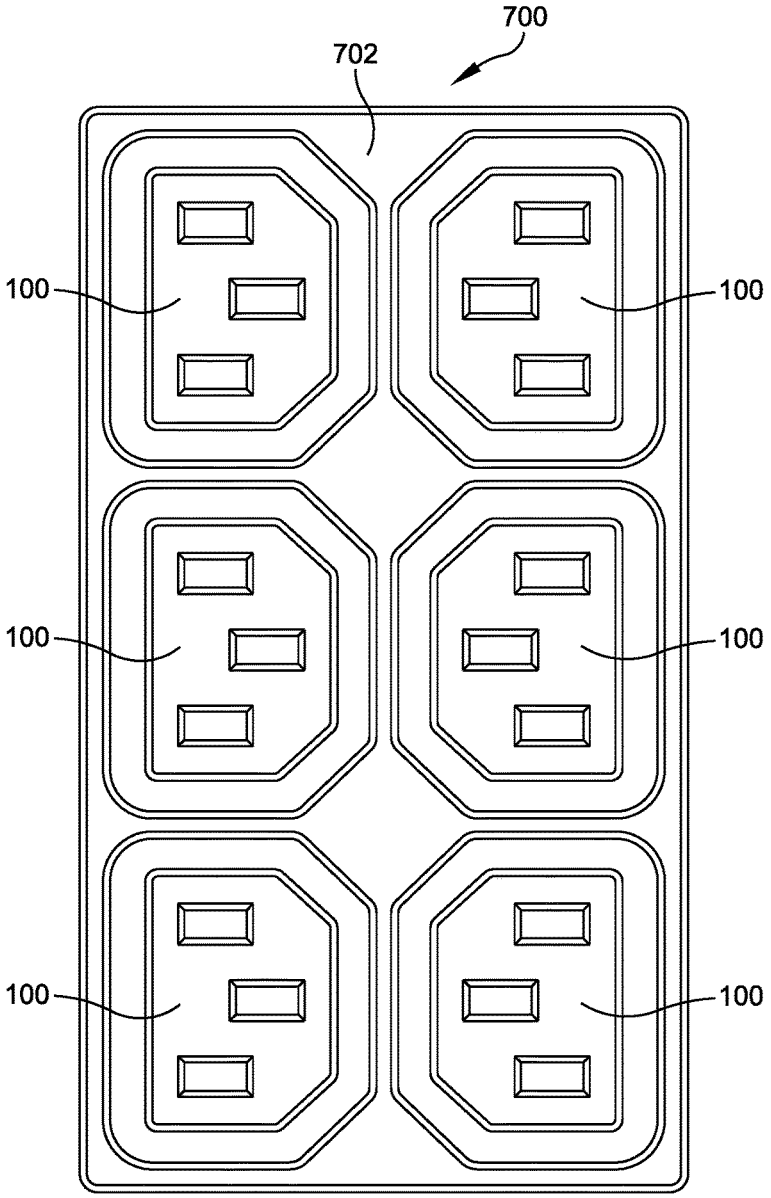
FIG. 7 illustrates a power strip according to aspects of the current invention.

As also described herein, the DC power outlet 100 is a single unit; however, in other embodiments, the DC power outlet 100 may be one of a plurality of DC power outlets 100 of a DC power distribution unit (e.g., a power strip). For example, FIG. 7 illustrates a DC power strip 700 in accordance with embodiments described herein. The DC power strip 700 includes a housing 702. Within the housing 702 is a plurality of the DC power outlets 100, each configured to be coupled to a power source and to be coupled to the plug of an electrical appliance as described above. As shown in FIG. 7, the DC power strip 700 includes six DC power outlets 100 arranged in two rows of three; however, in other embodiments, the DC power strip 700 may include any number of DC power outlets 100 arranged in any type of configuration.

Also, as discussed above, some aspects of embodiments described herein can be used with both AC and DC power outlets.

Therefore, at least some embodiments described herein provide a power outlet including a relay and a transistor coupled in parallel such that the transistor switches the power outlet and the relay carries the power provided to a load coupled to the power outlet. By switching the power outlet with the transistor and carrying the load with the relay, the potential arcing and damage issues identified above may be reduced.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A power distribution device including at least one power outlet, the at least one power outlet comprising:

a housing;

at least one receptacle within the housing, the at least one receptacle including an internal conductor configured to be coupled to a power source and to an external conductor inserted into the at least one receptacle;

a switch within the housing, the switch configured to provide an indication of whether the external conductor has been inserted at least to a predetermined point within the at least one receptacle;

a relay configured to be selectively coupled between the external conductor and the power source to form a first connection between the external conductor and the power source;

a transistor configured to be coupled between the external conductor and the power source, in parallel with the relay, to form a second connection between the external conductor and the power source; and a controller coupled to the relay, the transistor, and the switch, wherein the controller is configured to:

determine, based on the indication from the switch, that the external conductor is being removed from the at least one receptacle, in response to the determination that the external conductor is being removed from the at least one receptacle, control the relay to open and sever the first connection, in response to opening the relay, control the transistor to turn off after a predetermined transistor delay and sever the second connection, determine, based on the indication from the switch, that the external conductor is being inserted into the at least one receptacle;

in response to the determination that the external conductor is being inserted into the at least one receptacle, control the transistor to turn on and provide power from the power source to the external conductor via the second connection; and in response to turning on the transistor, control the relay to close after a predetermined relay delay and provide power from the power source to the external conductor via the first connection.

2. The power distribution device of claim 1, wherein the switch includes a mechanical switch having a first position that indicates to the controller that the external conductor has been inserted at least to the predetermined point within the at least one receptacle and a second position that indicates to the controller that the external conductor has not been inserted at least to the predetermined point within the at least one receptacle.

3. The power distribution device of claim 2, wherein the mechanical switch is one of a ball switch and a plunger switch.

4. The power distribution device of claim 1, wherein the switch includes an optocoupler pair including an optocoupler transmitter coupled to the housing and an optocoupler receiver located external the housing.

5. The power distribution device of claim 1, wherein the relay is a mechanical relay including a coil coupled to the controller via a relay control line and a contact configured to be selectively coupled between the external conductor and the power source in the second connection, and wherein in response to turning on the transistor, the controller is configured to transmit, after the predetermined relay delay, a relay control signal to the coil via the relay control line that results in the contact being coupled between the external conductor and the power source in the first connection.

6. The power distribution device of claim 5, wherein in response to the determination that the external conductor is being removed from the at least one receptacle the controller is further configured to end transmission of the relay control signal to the coil, resulting in the opening of the relay contact and the severing of the first connection.

7. The power distribution device of claim 1, wherein the at least one power outlet further comprises a transistor control line coupled between the controller and a gate of the transistor, and wherein in response to opening the relay, the controller is configured to transmit, after the predetermined transistor delay, a first transistor control signal via the transistor control line to the gate of the transistor, the first transistor control signal operating the transistor to turn off and sever the second connection.

8. The power distribution device of claim 7, wherein in response to the determination that the external conductor is being inserted into the at least one receptacle, the controller is further configured to transmit a second transistor control signal via the transistor control line to the gate of the transistor to turn on the transistor and provide power from the power source to the external conductor via the second connection.

9. The power distribution device of claim 1, wherein the power distribution device is a power strip including a plurality of the at least one power outlets.

10. The power distribution device of claim 1, wherein the power source is a DC power source.

11. A method for controlling a power outlet, the power outlet including a housing, at least one receptacle within the housing having an internal conductor configured to be coupled to a power source and to an external conductor inserted into the at least one receptacle, a switch within the housing, a relay configured to be selectively coupled between the external conductor and the power source, and a transistor configured to be coupled between the external conductor and the power source, in parallel with the relay, the method comprising:

inserting the external conductor into the at least one receptacle to couple the external conductor to the internal conductor;

providing, with the switch, an indication that the external conductor is being inserted into the at least one receptacle;

in response to the indication by the switch that the external conductor is being inserted into the at least one receptacle, controlling the transistor to turn on and provide power from the power source to the external conductor via the transistor;

in response to turning on the transistor, controlling, after a predetermined relay delay, the relay to close and provide power from the power source to the external conductor via the relay;

removing the external conductor from the at least one conductor;

providing, with the switch, an indication that the external conductor is being removed from the at least one receptacle;

in response to an indication by the switch that the external conductor is being removed from the at least one receptacle, controlling the relay to open and sever connection from the power source to the external conductor via the relay; and in response to opening the relay, controlling, after a predetermined transistor delay, the transistor to turn off and sever connection from the power source to the external conductor via the transistor.

12. The method of claim 11, wherein the switch includes a mechanical switch having a first state indicative of the external conductor being inserted into the at least one receptacle and a second state indicative of the external conductor being removed from the at least one receptacle, wherein inserting the external conductor into the at least one receptacle includes configuring the mechanical switch into the first state, and wherein removing the external conductor from the at least one receptacle includes configuring the mechanical switch into the second state.

13. The method of claim 11, wherein the relay includes a coil coupled to the controller via a relay control line and a contact configured to be selectively coupled between the power source and the external conductor, and wherein controlling the relay to close includes transmitting a signal to the relay to cause the contact to couple the power source to the external conductor.

14. The method of claim 13, wherein controlling the relay to open includes ending the transmission of the relay control signal to the relay to sever the connection between the power source and the external conductor via the relay.

15. The method of claim 11, wherein the power outlet further comprises a transistor control line coupled between the controller and a gate of the transistor, and wherein controlling the transistor to turn on includes transmitting a first signal to the gate of the transistor, the first signal operating to turn on the transistor and couple the power source to the external conductor via the transistor.

16. The method of claim 15, wherein controlling the transistor to turn off includes transmitting a second signal to the gate of the transistor, the second signal operating to turn off the transistor and sever the connection between the power source and the external conductor via the transistor.

17. A power distribution device including at least one power outlet, the at least one power outlet comprising:

a housing;

at least one receptacle within the housing, the at least one receptacle including an internal conductor configured to be coupled to a power source and to an external conductor inserted into the at least one receptacle; and means for determining whether the external conductor is being inserted into or removed from the at least one receptacle, for switching on the at least one power outlet with a transistor in response to a determination that the external conductor is being inserted into the at least one receptacle, for carrying power provided from the power source to the external conductor with a relay in response to turning on the at least one power outlet with the transistor, for discontinuing to carry power from the power source to the external conductor via the relay in response to a determination that the external conductor is being removed from that at least one receptacle, and for switching off the at least one power outlet with the transistor in response to discontinuing to carry power from the power source to the external conductor via the relay.

18. The power distribution device of claim 17, wherein the at least one power outlet further comprises means for determining whether the external conductor has been sufficiently inserted into the at least one receptacle of the at least one power outlet.

* * * * *